US008047239B2

(12) United States Patent
Hoyaukin

(10) Patent No.: US 8,047,239 B2
(45) Date of Patent: Nov. 1, 2011

(54) METHOD AND MACHINE FOR BINDING ELONGATE OBJECTS TOGETHER

(75) Inventor: Peter Hoyaukin, Stockholm (SE)

(73) Assignee: Tymatic Limited, Edgware (GB)

( * ) Notice: Subject to any disclaimer, the term of this patent is extended or adjusted under 35 U.S.C. 154(b) by 1118 days.

(21) Appl. No.: 10/548,882

(22) PCT Filed: Mar. 17, 2004

(86) PCT No.: PCT/SE2004/000391

§ 371 (c)(1),
(2), (4) Date: Oct. 19, 2005

(87) PCT Pub. No.: WO2004/083559

PCT Pub. Date: Sep. 30, 2004

(65) Prior Publication Data

US 2006/0157139 A1 Jul. 20, 2006

(30) Foreign Application Priority Data

Mar. 18, 2003 (SE) ..... 0300687
Aug. 25, 2003 (SE) ..... 0302276

(51) Int. Cl.
*B21F 7/00* (2006.01)
*B21F 15/04* (2006.01)
*B21F 9/02* (2006.01)

(52) U.S. Cl. ..... 140/119; 140/93.6

(58) Field of Classification Search ..... 140/93.2, 140/93.4, 93.6, 102, 149, 118–119
See application file for complete search history.

(56) References Cited

U.S. PATENT DOCUMENTS

| | | | | |
|---|---|---|---|---|
| 3,391,715 | A * | 7/1968 | Thompson | 140/93.6 |
| 4,117,872 | A * | 10/1978 | Gott et al. | 140/57 |
| 5,217,049 | A * | 6/1993 | Forsyth | 140/93.6 |
| 5,323,816 | A | 6/1994 | Hoyaukin | |
| 5,682,927 | A * | 11/1997 | Takahashi et al. | 140/119 |
| 5,947,166 | A | 9/1999 | Doyle et al. | |
| 2005/0005992 | A1 * | 1/2005 | Kusakari et al. | 140/119 |

FOREIGN PATENT DOCUMENTS

| | | |
|---|---|---|
| EP | 0829596 A1 | 3/1998 |
| EP | 1070808 A1 | 1/2001 |

* cited by examiner

*Primary Examiner* — Teresa Ekiert
(74) *Attorney, Agent, or Firm* — Sughrue Mion, PLLC

(57) ABSTRACT

Machine for binding elongate objects together by at least one wire, in particular for lashing reinforcing bars, electric cables or the like. The machine includes two claws which can be guided down over the objects to be bound together. Feed rollers are arranged for feeding the wire along a guide surface of one claw and across to a guide surface of the other claw, so that it is shaped into a wire loop surrounding the objects on three sides, the legs of which loop can be twisted together on the fourth side of the objects. The twisting-together device includes an arrangement, which is rotatable relative to the claws, and which guide the wire when it is fed to and from the claws. The twisting-together arrangement allows the wire length necessary for twisting-together of the legs of the wire loop to be drawn out while a resistance is overcome.

23 Claims, 12 Drawing Sheets

METHOD AND MACHINE FOR BINDING ELONGATE OBJECTS TOGETHER

FIELD OF THE INVENTION

The present invention relates to a method for binding elongate objects together by means of at least one wire, in particular for lashing reinforcing bars, electric cables or the like, two claws provided with guide surfaces for the wire being guided down over the objects to be bound together, after which a wire is fed along the guide surface of one claw and across to the guide surface of the other claw, so that it is shaped into a wire loop surrounding the objects on three sides, and the legs of the wire loop are twisted together on the fourth side of these objects.

The invention also relates to a machine for use in implementing such a method.

BACKGROUND OF THE INVENTION

Conventionally, the lashing of reinforcing bars to form reinforcing mats is carried out with the aid of simple, manual tools, which is a very time-consuming and thus expensive and also laborious operation, which is apt to give rise to attritional injuries. The reason for this is that, when lashing reinforcing mats for concrete slabs, arches or the like using previous aids, the operator has to bend for long periods of time, which leads to great stress on the back.

In this connection, the lashing of the reinforcing bars is usually effected with the aid of tongs or a twisting tool, by means of which the ends of a wire, which is arranged by hand around the reinforcing bars at the various intersection points, are twined or twisted together for firm connection of the bars. Carrying out lashing in the conventional manner also involves risks of accident, especially in the case of work on roofs, bridges and the like, owing to the stooped working position which, inter alia, leads to risks of falling accidents.

In my International patent application PCT/SE91/00571, a machine is described for binding intersecting bars together by means of wires, in particular for lashing reinforcing bars, which machine works in accordance with the method indicated in the first paragraph above. By means of this machine, the lashing operation can be made considerably more efficient at the same time as the abovementioned risks of injury can be eliminated or considerably reduced, as this machine allows the operator to work upright.

In known lashing machines, which are provided with a rotatable twisting head arranged above the jaws so as to replace the manual twisting-together of the wire ends with the aid of tongs or the like, there is inter alia a risk of the lashing wire breaking as a result of excessive tension in it if the wire parts are secured in the twisting head. Furthermore, it can be difficult, owing to tensile forces in the wire, to make the latter surround the reinforcing bars closely at the twisting location.

The present invention is based on the knowledge that this is due to the fact that the machine cannot imitate the movement of the hand during manual twisting. When manual twisting-together of two wire ends is carried out, the wire is first stretched around the reinforcing bars. During twisting, the hand and thus the wire ends will then approach the upper reinforcing bar in the course of twisting owing to the fact that the twisting itself requires a certain wire length.

In a twisting machine with a rotatable twisting head, the wire ends are usually secured in the twisting head throughout the twisting operation, which means that the extra wire length required for the twisting itself cannot be fed down through the twisting head. This results in increased tension in the wire, which may lead to the latter breaking and those portions of the wires which are twisted together being drawn up from the reinforcing bars, so that an interspace is formed between the uppermost bar and the twisted-together portions of the wire ends.

Another disadvantage of known lashing machines is that they comprise pivotable claws which have to be closed and opened a great many times a day by hand movements of the operator, which is very tiring. Moreover, the risk of functional disorders of the machine increases.

OBJECTS OF THE INVENTION

One object of the present invention is to provide a method for binding elongate objects together in the way indicated in the first paragraph above, which can be implemented without risk of the wire breaking or the attachment of the wire loop obtained to the objects being defective.

Another object is to provide a simple, reliable machine for use in implementing the method.

The invention is based on the knowledge that the abovementioned aims can be achieved by virtue of the twisting head being made so that the wire ends are held in it in such a way that wire can be drawn out from the head when the tension in the wire exceeds a given value during a twisting operation.

According to the present invention, a method of the type indicated in the first paragraph is then particularly characterized in that the wire is fed to the said guide surface of one claw via a first guide arrangement in an arrangement which is rotatable relative to the claws, and is fed away from the second claw via a second guide arrangement in the rotatable arrangement, in that the rotatable arrangement is made to rotate for twisting-together of the two parts of the wire for binding together the objects the wire surrounds, and in that, during twisting together, the wire is held in each guide arrangement in the said rotatable arrangement such that the wire length necessary for twisting-together of the wire parts is allowed to be drawn out while a resistance is overcome.

By virtue of the fact that wire can be drawn out from the twisting head during twisting together, no detrimental tension or traction arises in the wire, which may cause the wire to break. As the drawing-out of wire takes place counter to a certain resistance, the twisting-together will take place closely adjacent to the objects to be bound together. In this way, functioning similar to that during manual twisting is achieved.

In a preferred embodiment, a retracting force is applied to the wire after it has been fed but before twisting together has started. In this way, the wire is stretched, so that it surrounds very closely the objects to be bound together, which further improves the twisting result.

The wire is suitably fed to the claws from a reel and is cut off before the rotatable arrangement is made to rotate. During the feed of the wire from the guide surface of one claw to the guide surface of the other claw, the wire is guided by a movable means which is guided by the first said claw and is carried along by the wire in its feed movement. This allows the use of fixed claws, which is a very great advantage since, inter alia, tiring hand movements are avoided, and because a machine of the type described has to be very robust and impact-resistant in order to cope with the very rough treatment to which it is usually subjected on a building site.

The particularly characteristic features of a machine for use in implementing the method emerge from the first independent claim directed to the machine.

An especially preferred embodiment of this machine is characterized in that the rotatable arrangement is in the form of a cylinder with guide ducts for the wire passing through in the axial direction and in that the said cylinder is arranged rotatably in a cylindrical guide.

Further features of the invention emerge from subsequent claims.

The invention will be described in greater detail below with reference to the embodiments shown by way of example in accompanying drawings.

BRIEF DESCRIPTION OF THE DRAWING FIGURES

DETAILED DESCRIPTION OF EMBODIMENTS OF THE MACHINE

Figure 1:
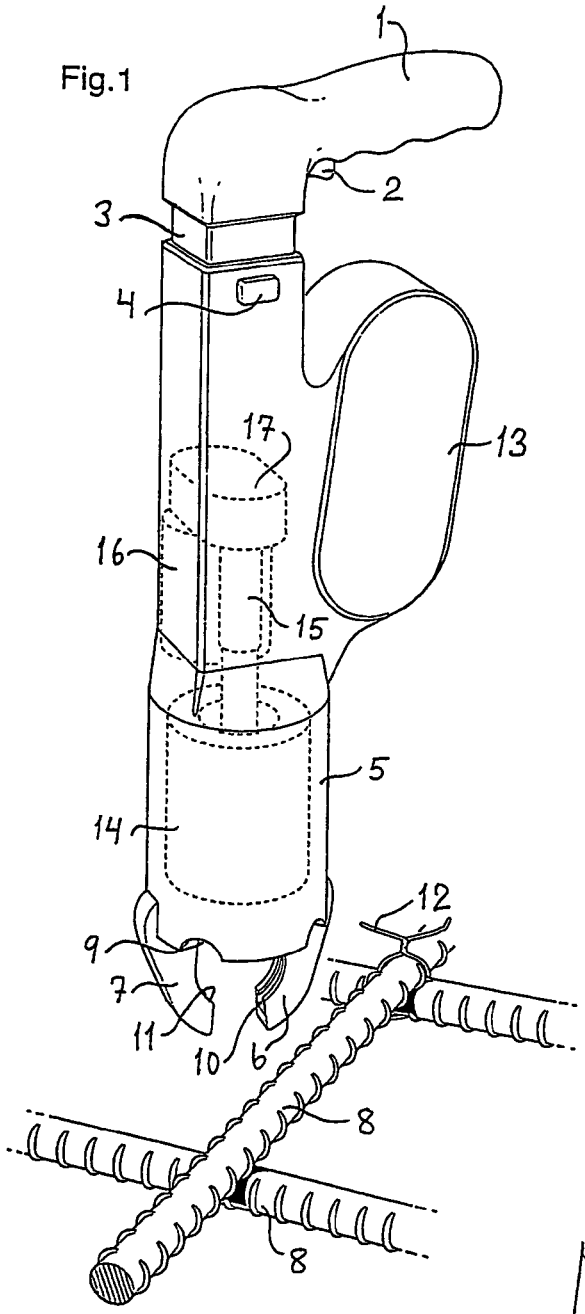
FIG. 1 shows diagrammatically a machine according to the invention before a work operation.

FIG. 1 illustrates diagrammatically the basic construction of one embodiment of a machine according to the invention. Reference number 1 designates a handle and 2 an activating switch. The handle 1 is connected to the rest of the machine via a telescopic part 3 which can be freed and set in different positions by means of a locking button 4. In this way, the overall length of the machine can be adapted depending on the work operation concerned and the height of the operator.

Figure 2:
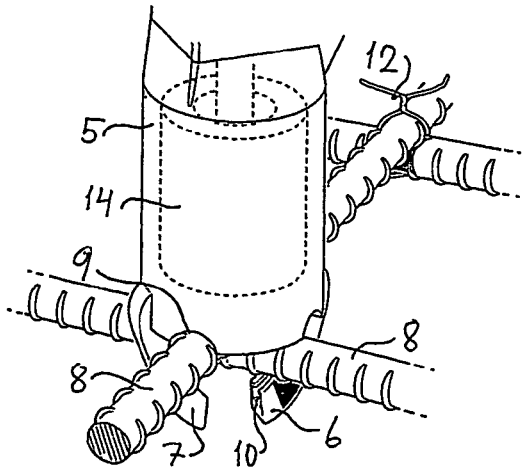
FIG. 2 illustrates how the lower part of the machine is positioned over an intersection of reinforcing bars to be bound together.

The machine comprises two fixed claws 6 and 7 connected firmly to the cylindrical outer casing 5. The claws are separated from one another by a spacing which allows them to be guided down over an intersection of reinforcing bars 8 or other objects to be bound together. In this connection, the outer casing 5 is designed as a supporting body with a seat 9 adapted to the shape of the reinforcing bars 8. Before a lashing operation, the machine can then be set down on the reinforcing bars 8, so that it rests on these (see FIG. 2).

The claws 6, 7 are made with guide grooves 10 and, respectively, 11 for a lashing wire 12 which is used for binding reinforcing bars together. This is effected by wire from a wire reel arranged in the housing 13 being fed to a twisting arrangement 14 which, after the wire has been made to surround two intersecting reinforcing bars by means of the claws 6, 7 and after cutting off the wire, twists together the two legs of the wire loop obtained, as will be described in greater detail below.

The twisting head 14 is driven by a shaft 15 from an electric motor 16 via a gear reduction device 17.

Further components of one embodiment of the machine and a work cycle for it will now be described in greater detail with reference to FIGS. 3-8. In addition to parts described previously, these figures show diagrammatically a battery 18, which drives the motor 16. The housing 13 contains a reel 19 for lashing wire 12, which reel can, in connection with lashing wire being drawn off from it by means of two feed rollers 20, be displaced along a guide in the wire-feed direction while compression of a spring 21 takes place. Reference number 22 designates a knife, arranged in the fixed outer casing, for cutting off the wire 12 before a twisting-together operation.

The twisting head consists of an inner cylinder 14, which is mounted rotatably in the cylindrical outer casing 5. The inner cylinder 14 comprises two feed and guide ducts 23 and 24 for the lashing wire. Also mounted in the inner cylinder 14 is a scissors-like construction which comprises two legs which are pivotable relative to one another and can be pressed apart by virtue of a suitably somewhat elastic ball 25 being pressed downwards between the upper ends 26 of the legs, which results in the lower ends 27 of the legs being pressed outwards and entering into braking engagement with lashing wire fed into the ducts 23 and 24, as will be described in greater detail below. Owing to the lever action obtained, it will be possible for the leg ends 27 to be pressed outwards with great force.

The ball 25 is provided with a guide pin 29 which is inserted freely into a threaded spindle 28 and can be pressed into the spindle 28 counter to the action of a spring 30. Reference number 31 designates a bearing arrangement which prevents the guide pin 29 and the ball 25 being carried along in the rotation of the spindle 28.

The threaded spindle 28 interacts with a corresponding thread in a hole 32 in a top closure of the outer, fixed cylinder 5. The threaded spindle 28 merges with an upper, smooth part 43 with a driving pin 33 which projects out into a slot 34 in a tubular driving shaft 15 from the gear reduction device 17.

Reference number 35 designates a solenoid which is fed via slip-ring contacts 36 and actuates a locking means 37 which, when the solenoid is activated, is pressed in and fixes a lashing wire 12, which has been introduced into the duct 24, so that it cannot be retracted.

As shown in the section through the claw 6 in FIG. 3A, a channel-shaped guide device 38 is arranged in the guide groove 10 in the claw 6. The channel-shaped guide device 38 is arc-shaped and displaceable along the claw, as will be described in greater detail below. The guide channel 38 is connected via a line 39 to a spring-loaded roller 40, so that displacement of the guide channel 38 takes place while a spring in the roller 40 is tensioned.

At its front edge, the guide channel 38 is made with a stop surface 41, with which the front end of the lashing wire 12 will interact in order to carry the guide channel along in its feed movement. The opposite claw 7 comprises a recess 42 adapted to receive a part of the front part of the guide channel 38 in order to free the front end of the wire 12 from the stop surface 41, as will be explained in greater detail below.

In order for it to be possible to bring about reliable guidance of the wire during its feed, the guide groove 11 in the second claw 7 is closed by means of two spring-loaded, cover-like elements 44 (see FIG. 3B) which can be displaced in the direction away from one another when a wire 12 is drawn out from the guide groove 11 in the lateral direction, as will be described in greater detail below.

Figure 3:
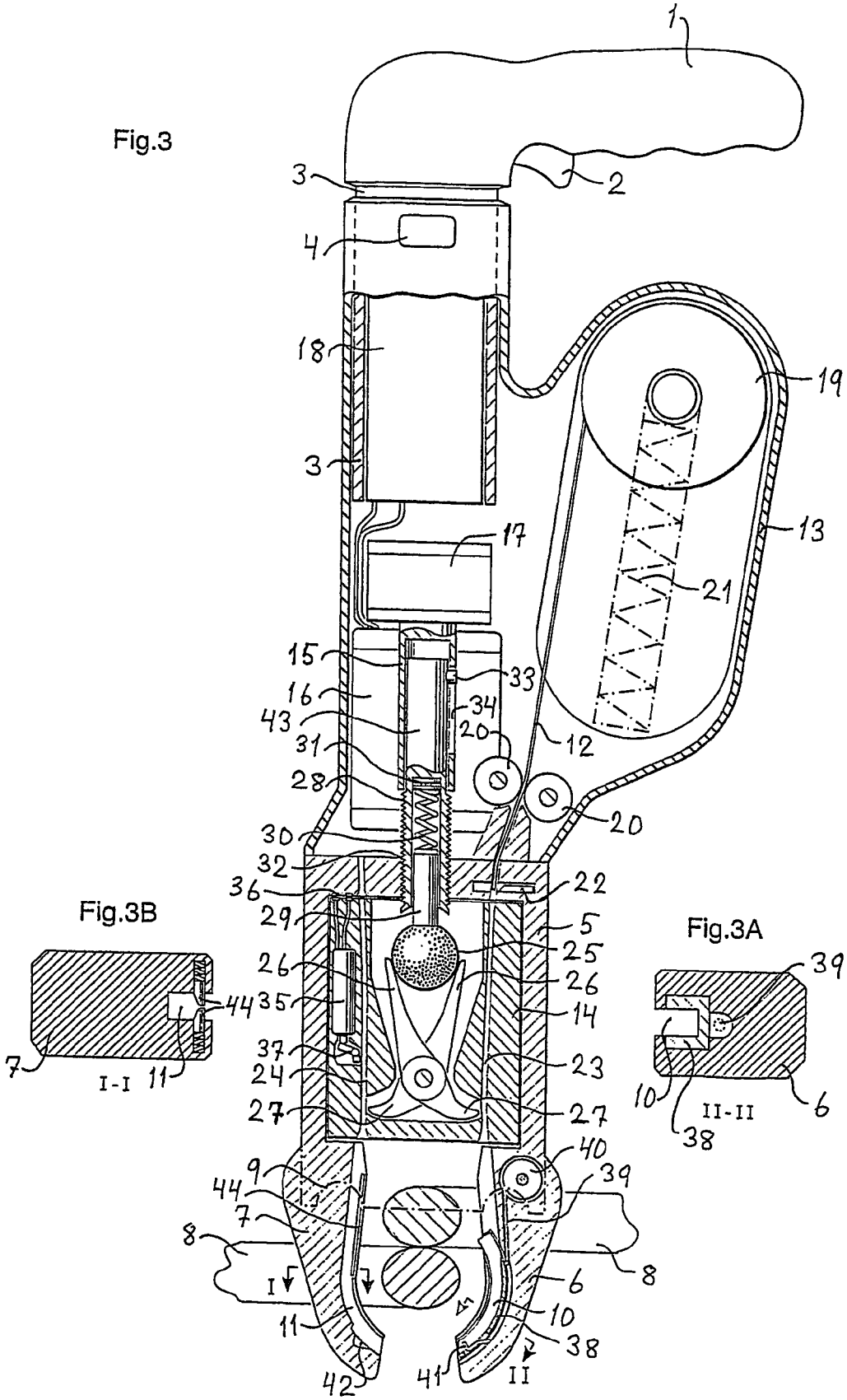
FIGS. 3-8 show one embodiment of the machine according to the invention partly in section and in various states during the performance of a work cycle.

In FIG. 3, the machine has been set down, so that it rests on the upper of two intersecting reinforcing bars 8, and is ready for feed of the lashing wire 12, which has been cut by means of the knife 22 in a previous lashing operation.

Figure 4:
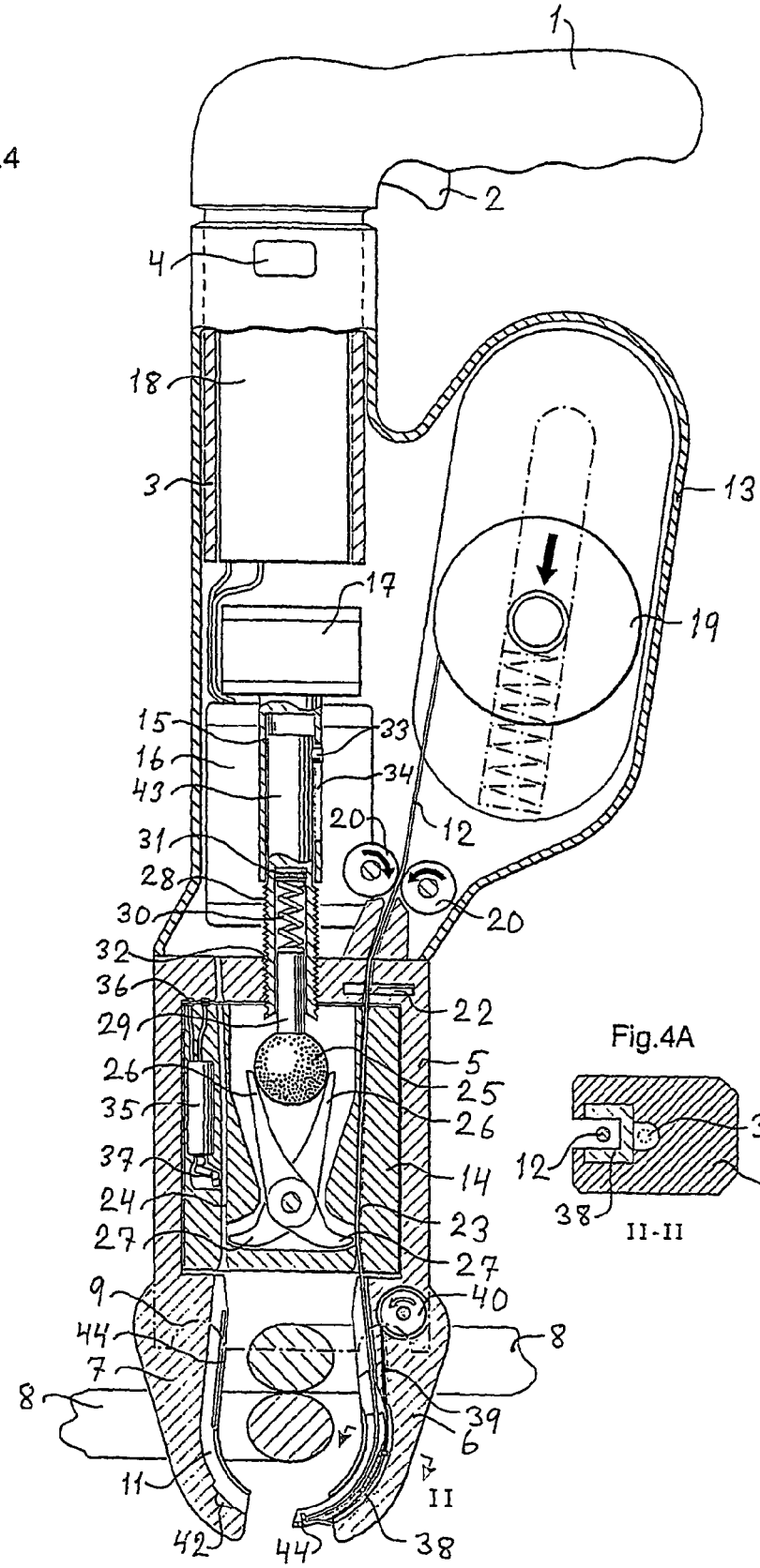
Figure 4A:
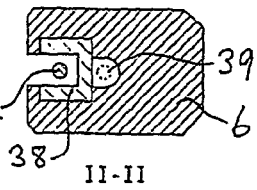

FIG. 4 illustrates how the feed rollers 20 have been started for drawing a wire 12 off from the reel 19. This has then been displaced along its guide in the wire-feed direction while compressing the spring 21. The spring 21 should be so weak that it is compressed when wire is drawn off but is still capable of returning the reel 19 to its upper end position when wire is fed back into the space in the housing 13. If so required, the housing 13 can be provided with means which interact with the reel 19 to bring about a certain braking of the rotation of the reel in order to ensure that the reel is displaced counter to the action of the spring 21 during drawing-off of wire. In this figure, the wire 12 has been fed down to the guide channel 38 mounted in the claw 6, so that the front end of the wire has come into contact with the front stop wall 41 of the channel and has in this connection carried the channel along in its continued feed movement. The wire 12 will therefore, during its passage across the gap between the claws 6 and 7, be guided by a guide channel 38 carried along by the wire itself. The use of such a guide channel makes it possible to make the machine with fixed claws which do not have to be capable of moving towards one another during feed of the wire, which is a very great advantage from a number of points of view, as mentioned above.

Figure 5:
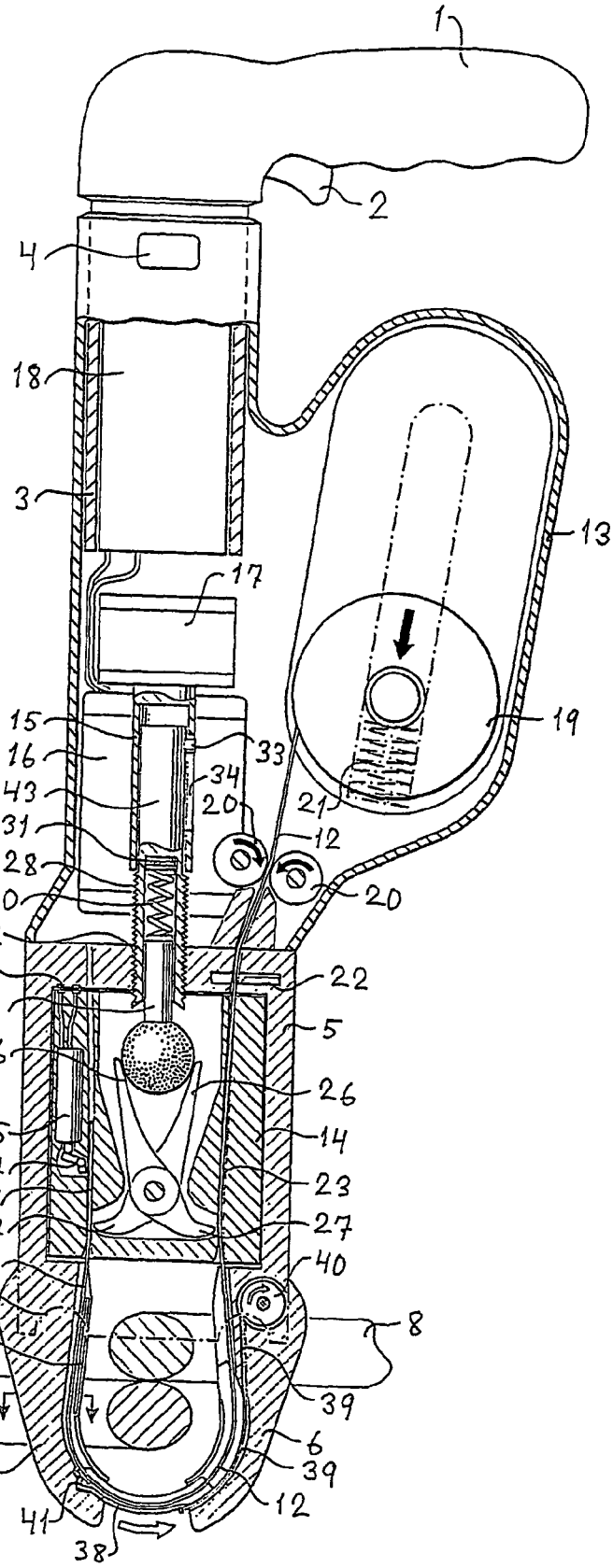
Figure 5A:
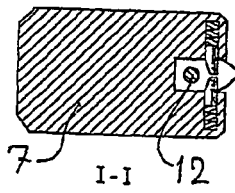

It can be seen from FIG. 5 how, as a consequence of the continued feed of the wire 12, the front part of the guide channel 38 has reached the guide groove 11 of the second claw 7 and has in this connection been inserted into a recess 42. The result of this is that the front end of the wire has been freed from the stop wall 41 and fed up further into the guide groove 11 in the claw 7 (see FIG. 5A). In the position shown in FIG. 5, the end of the wire 12 has been fed up into the guide duct 24 in the inner cylinder 14 past the position of the fixing device 37 operated by means of the solenoid 35.

Figure 6:
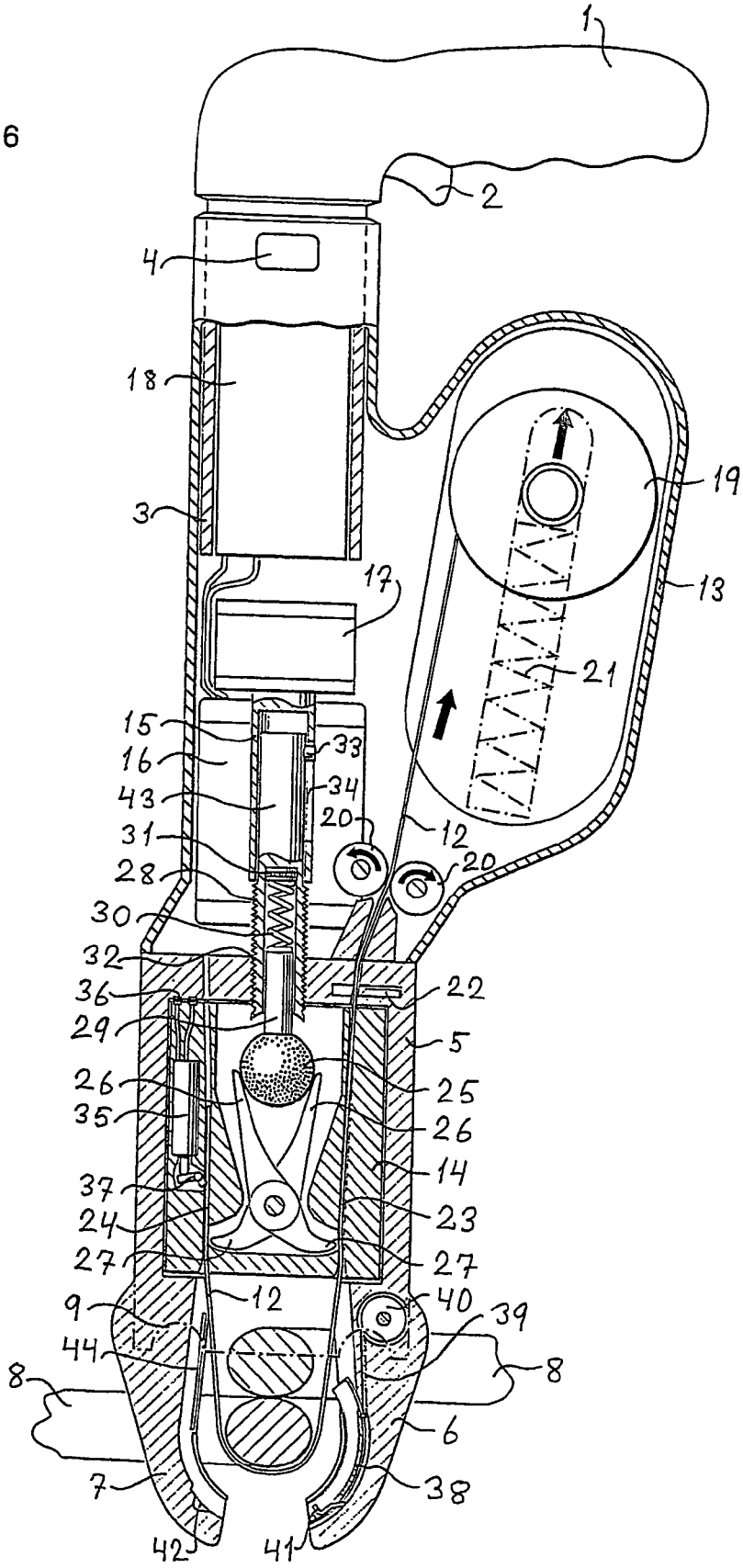

In this position, the feed of the wire is stopped, and the solenoid 35 is activated, so that the front end of the wire is fixed in the guide duct 24 in the cylinder 14 (see FIG. 6). When this has taken place, the driving direction of the feed rollers 20 is reversed, a certain length of the wire 12 then being retracted. The length of wire retracted is inserted into the housing 13, the wire reel 19 being returned under the action of the spring 21. This return is also assisted by the feeding-back of the wire, it being possible for the reel to be locked for rotation in the clockwise direction. If so required, however, the reel 19 can also be rotated for taking up retracted wire. In the case of rigid wire, however, it is preferred that the wire only has to be fed into the casing 13 by the rollers 20 and under the influence of the tensile force from the spring 21.

When the retraction described of the wire 12 takes place, the latter will be drawn out in the lateral direction from the outwardly open guide channel 38 in the claw 6 and will also be drawn out in the lateral direction from the guide groove 11 in the claw 7. The cover-like closing elements 44 will then be pressed apart by the wire counter to the action of associated springs. The position shown in FIG. 6 is then reached, in which the wire 12 closely surrounds the reinforcing bars 8 to be twisted together in the same way as in the case of a manual lashing operation. In this connection, the spring-loaded spool 40 has also, via its line 39, drawn the guide channel 38 back into its starting position in the claw 6.

Figure 7:
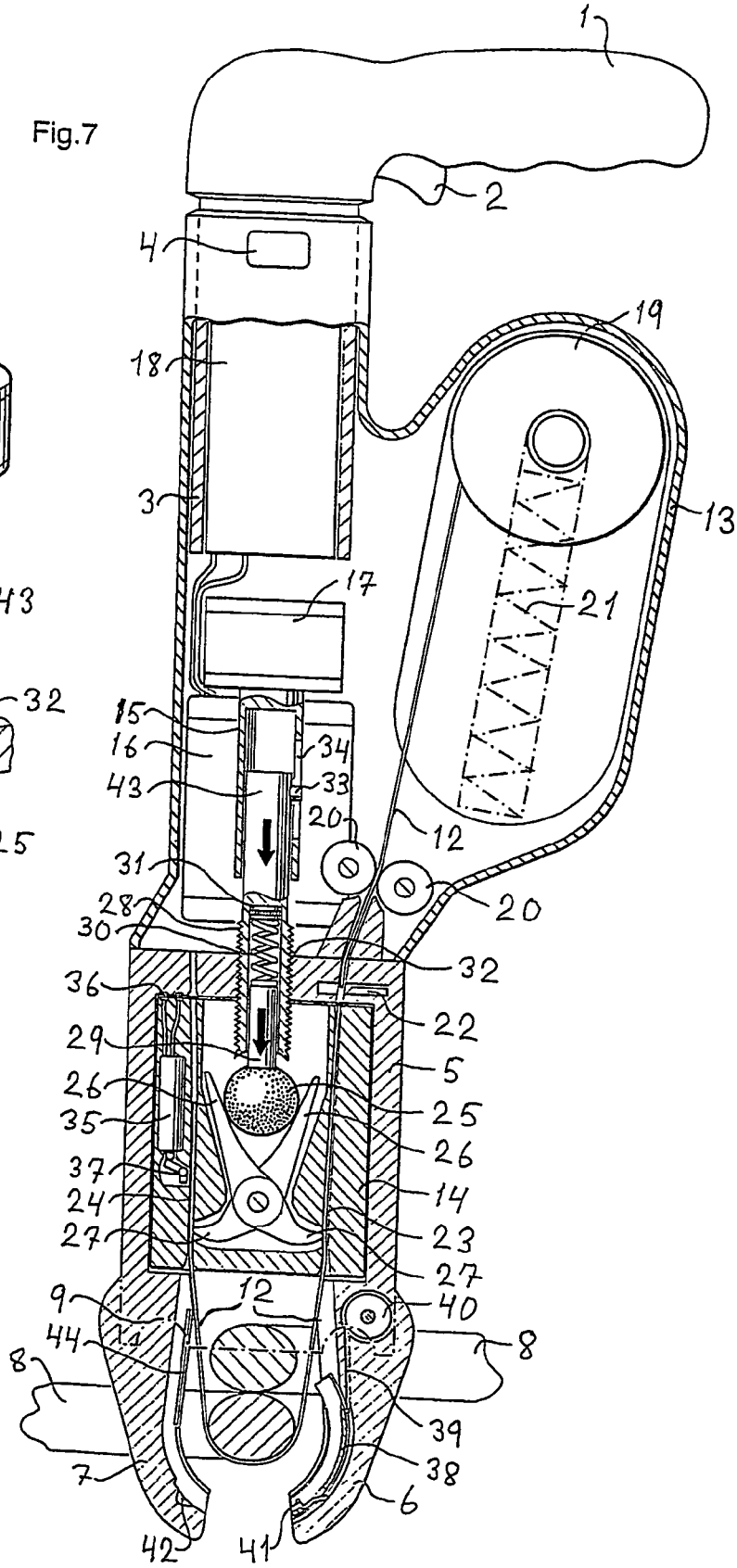
Figure 7A:
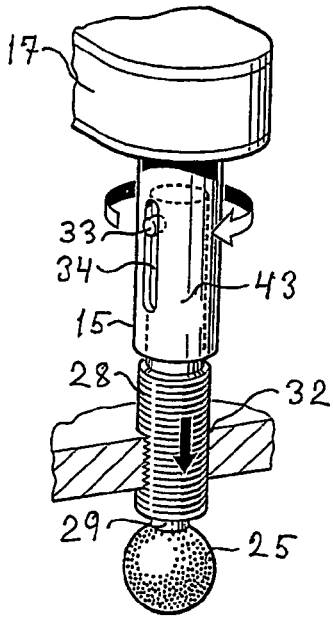

Before twisting together, the wire 12 is cut off by means of the knife 22, and the solenoid 35 is deactivated, so that the locking means 37 frees the wire end (see FIG. 7). Furthermore, the motor 16 is started, which causes the tubular output shaft 15 of the gear reduction device 17 to begin to rotate (see also FIG. 7A). The spindle 43 provided with the driver pin 33 will be carried along in this rotation, which leads to the lower, threaded part 28 of the spindle drawing the spindle downwards, the driver pin 33 running in the slot 34. In this connection, the spring 30 and the guide pin 29 will press the somewhat elastic ball 25 down between the upper ends 26 of the scissors-like arrangement in the cylinder 14. This means that the lower ends 27 of the legs will be pressed out into firm engagement with the wire 12 in the guide ducts 23 and 24 in the cylinder 14. This takes place without any rotation of the scissors-like construction or the cylinder 14 on account of the guide pin 29 and the spring 30 being freely guided in the sleeve-shaped spindle 28.

When the spindle 28 has descended to the ball 25, the engagement of the leg ends 27 with the wire 12 in the guide ducts 23, 24 has reached such a value that the wire ends are retained securely in the guide ducts but in such a way that they can still, when a certain tensile force arises in the wire, be drawn out of the guide ducts owing to the fact that at least the surface layer of the ball 25 is elastic.

Figure 8:
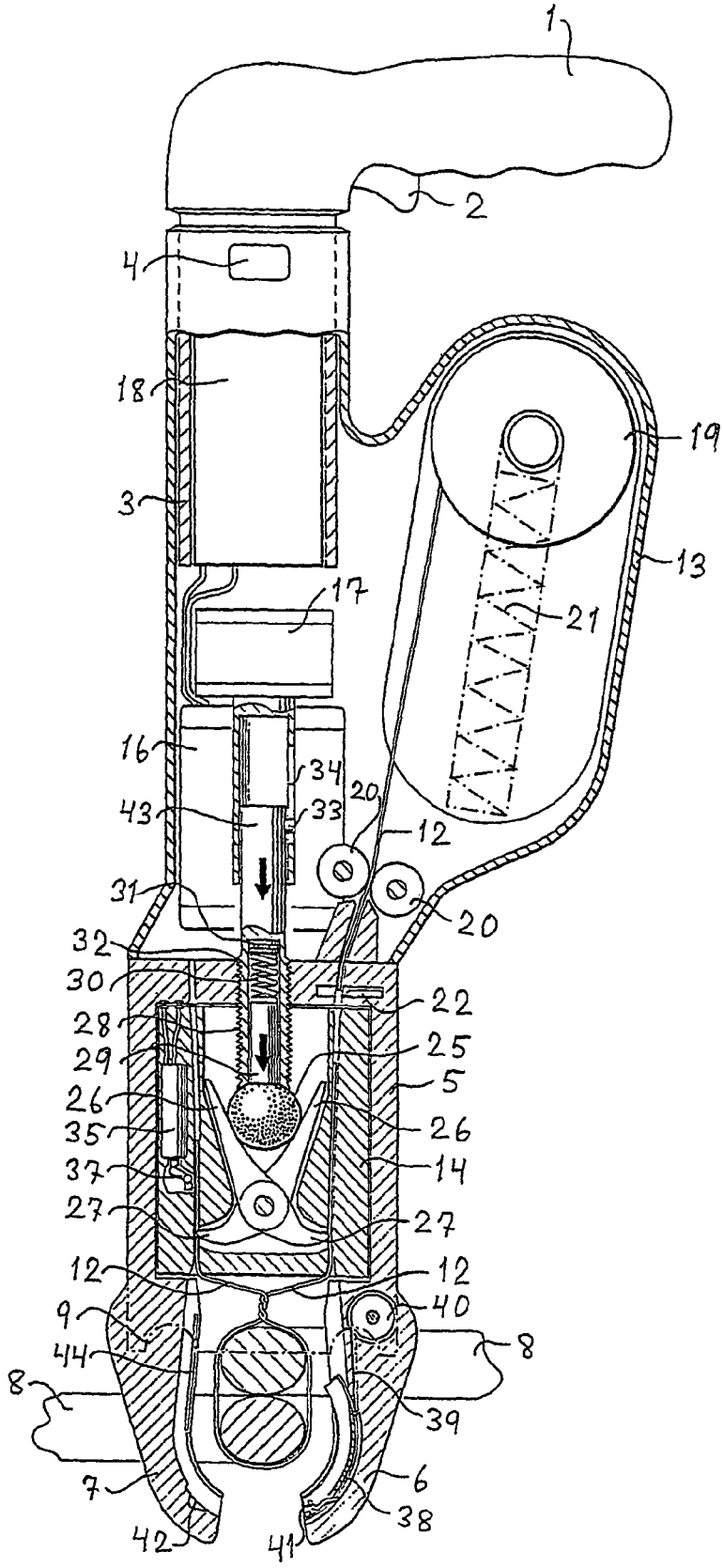

In this position, the threaded spindle 28 will make contact with the elastic ball 25 and will then carry both the ball and the scissors-like construction and thus the inner cylinder 14 as well along in its continued rotational movement (see FIG. 8). This is effected while certain additional deformation of the elastic ball 25 takes place. Owing to the rotation of the inner cylinder 14, the ends of the wire 12 will be twisted together on the top side of the uppermost reinforcing bar 8 and will in this connection bring about secure binding-together of the reinforcing bars at the intersection point. To achieve tight binding-together of the reinforcing bars, the spacing between the mouths of the two guide ducts 23, 24 in the inner cylinder 14 and the spacing between the lower surface of the latter and the top surface of the uppermost reinforcing bar should be selected depending on the dimensions of the reinforcing bars to be bound together. The man of art can easily establish suitable values for these spacings by experimentation, so that twisting takes place while the wire ends are drawn in the lateral direction, like when tying a shoelace. It is then possible to achieve as tight a binding-together of the reinforcing bars as is illustrated in FIG. 8. A distance between the lower surface of the inner cylinder and the top surface of the uppermost reinforcing bar of the order of 1 cm gives sufficient space to accommodate the twist and results in a good twisting result. In this connection, it may prove suitable to arrange a rubber ring in the mouth of each guide duct in order to increase the friction against the wire.

The embodiment described above includes separate means, the scissors-like construction, for securing the wire in the guide ducts.

However, such means can normally be dispensed with, especially when using a relatively stiff lashing wire, such as that which is used for instance in Sweden for lashing reinforcing bars in concrete constructions. Due to the stiffness of the wire, after the wire has been drawn off from the reel it tends to resume its curved shape which leads to the wire being pressed against the walls of the guide ducts at various positions. This results in an increased friction between the wire and the walls of the ducts.

Further, as the wire during a twisting operation is pulled out obliquely from the mouths of the two guide ducts the wire is bent around and pressed against the edge of each mouth. This gives rise to a substantial increase of the force required to pull out the wire from the guide ducts.

Thus, there is normally such a resistance against the pulling out of the wire that a tight twist is obtained without the use of any separate securing means in the guide ducts.

This makes it possible to design a very simple, robust and reliable lashing machine the lashing head of which in its simplest embodiment may comprise an inner rotable cylinder provided with two guide ducts for the lahing wire and an outer, fixed guiding cylinder.

Such a preferred embodiment of the present invention will now be described with reference to FIGS. 9-13 which correspond to and show the machine of this preferred embodiment in the same states and situations as the already described embodiment has been shown in FIGS. 3-6 and 8. Parts of the preferred embodiment which directly correspond to parts of the already described embodiment have been give the same reference numerals as in that embodiment. Such parts and their operation will not be described once again.

Figure 9:
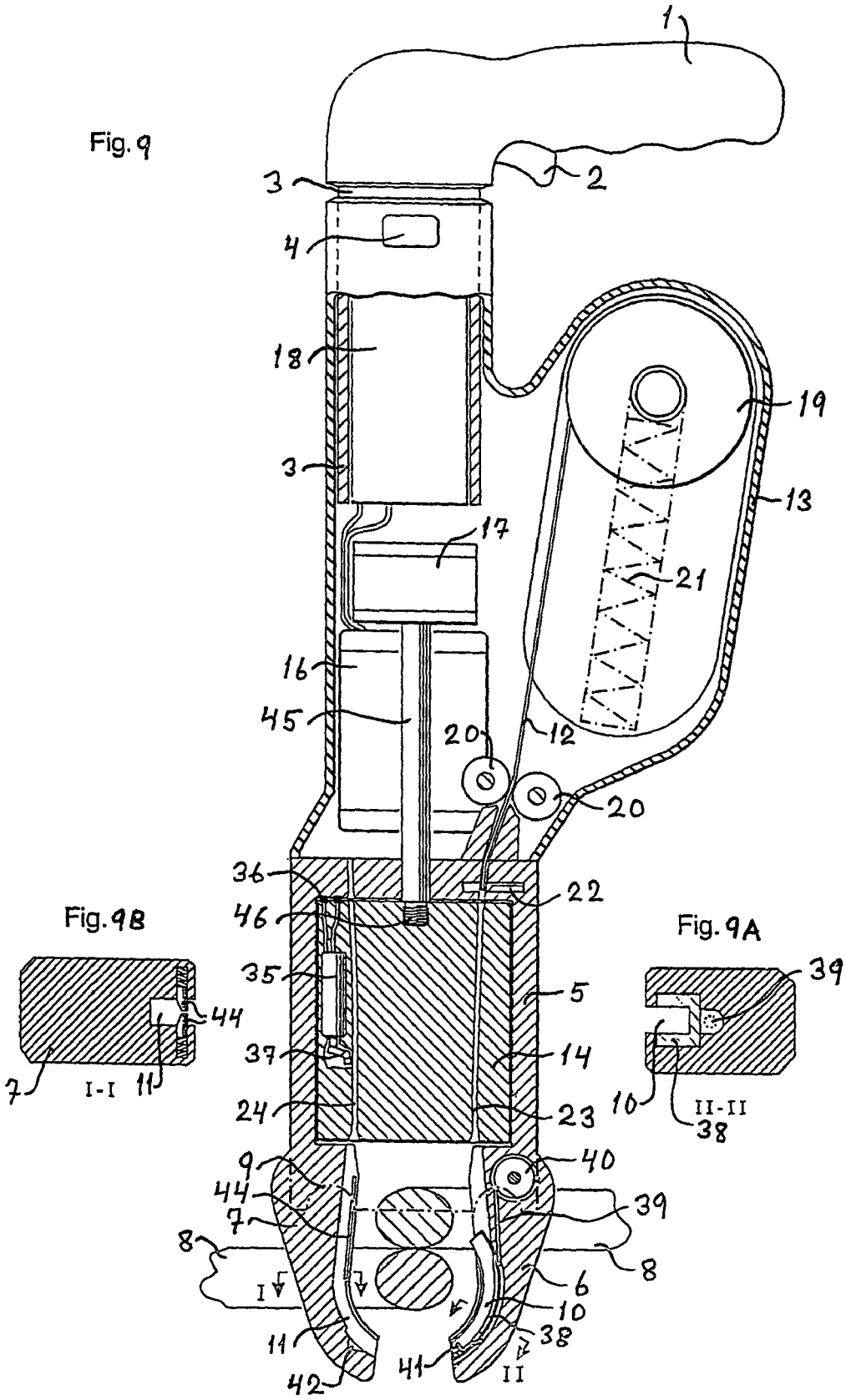
FIGS. 9-13 show a preferred embodiment of the machine in the same states as shown in FIG. 3-8

In FIG. 9 the lashing machine is shown in the same state as in FIG. 3. The scissors-like construction has been dispensed with and the twisting head comprises just an inner rotatable cylinder 14 which is driven by a shaft 45 from the gear reduction device 17 and guided in the outer cylindrical casing 5. The inner end 46 of the shaft 45 is threaded into the inner cylinder 14. However, the shaft can be coupled to the inner cylinder also by other means as is realized by the skilled man.

Like the previously described embodiment the inner cylinder 14 comprises two feed and guide ducts 23 and 24 for the lashing wire 12 and solenoid 35 which actuates a locking means 37 in the guide duct 24.

Figures 10, 10A:
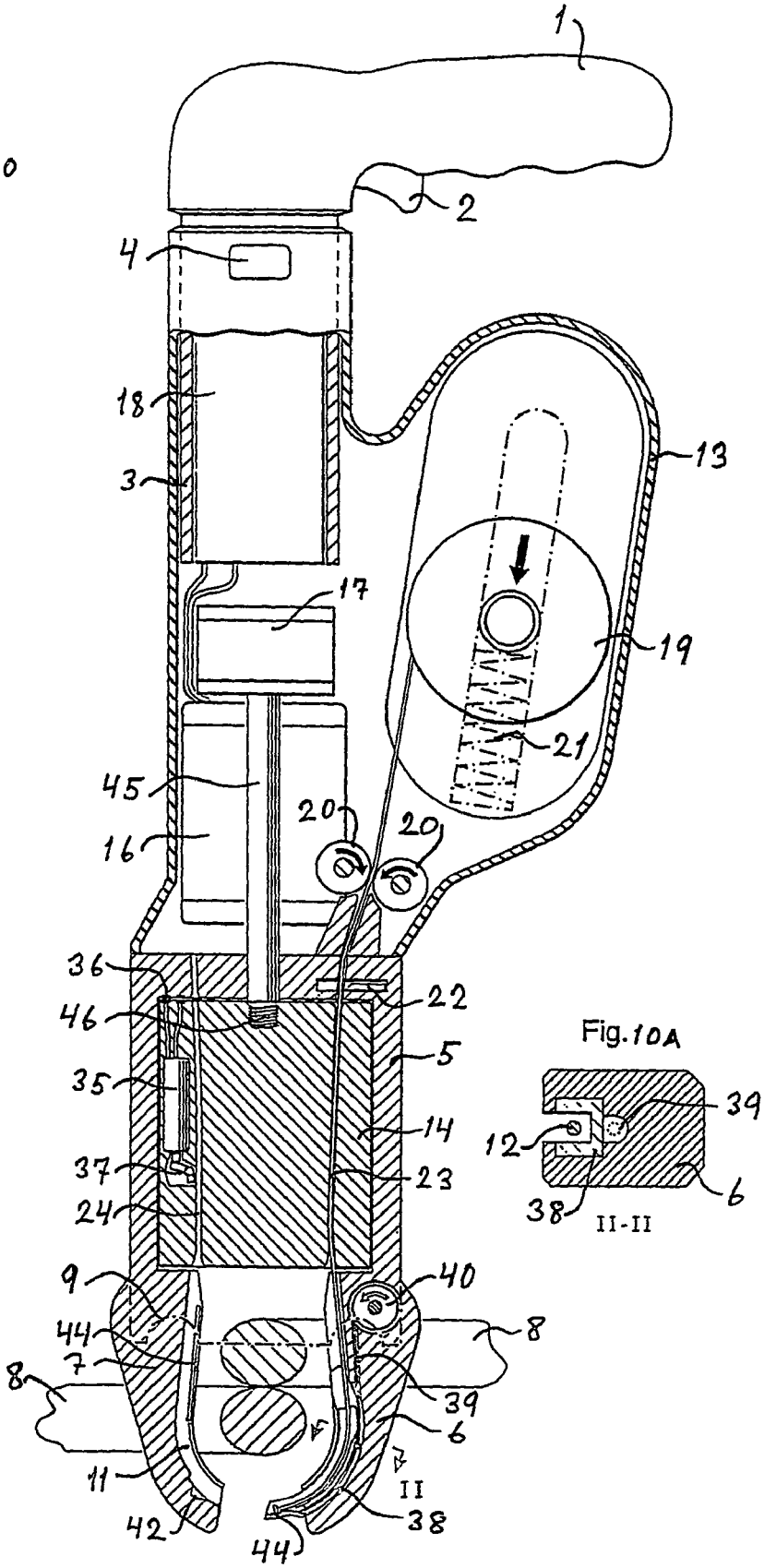
Figure 11:
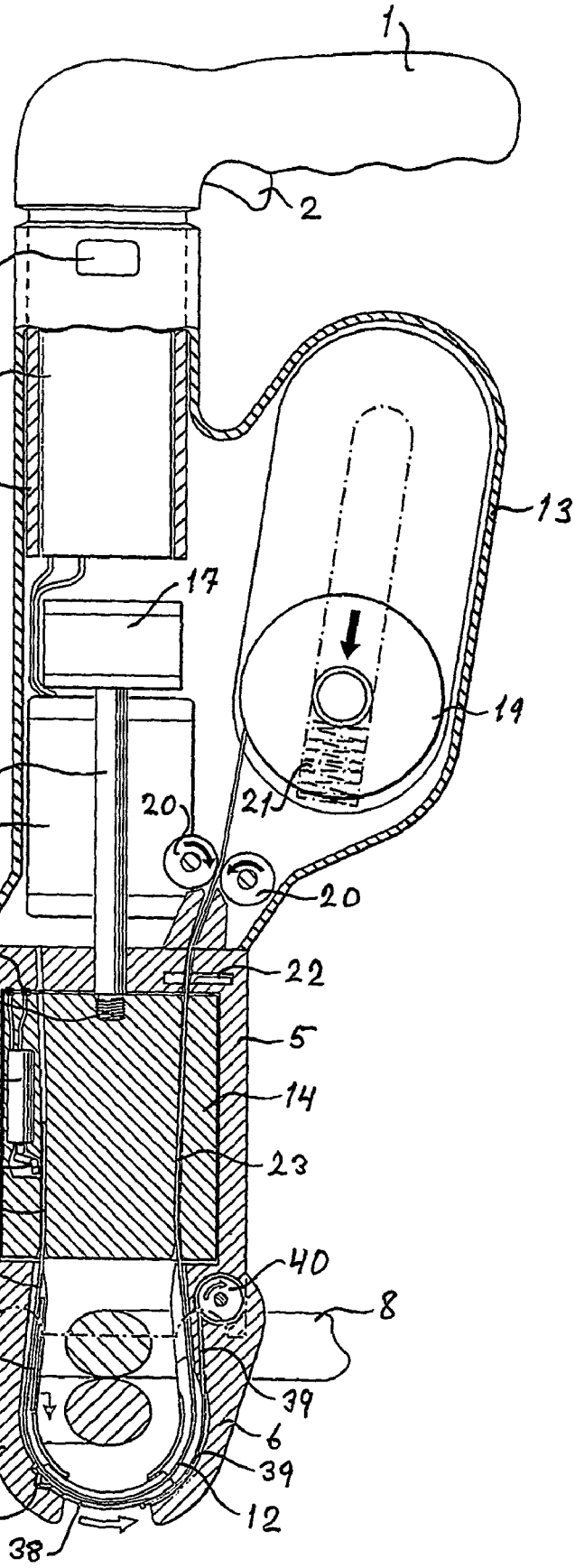
Figure 11A:
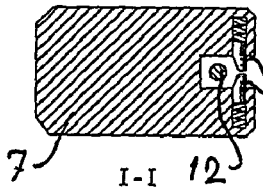
Figure 12:
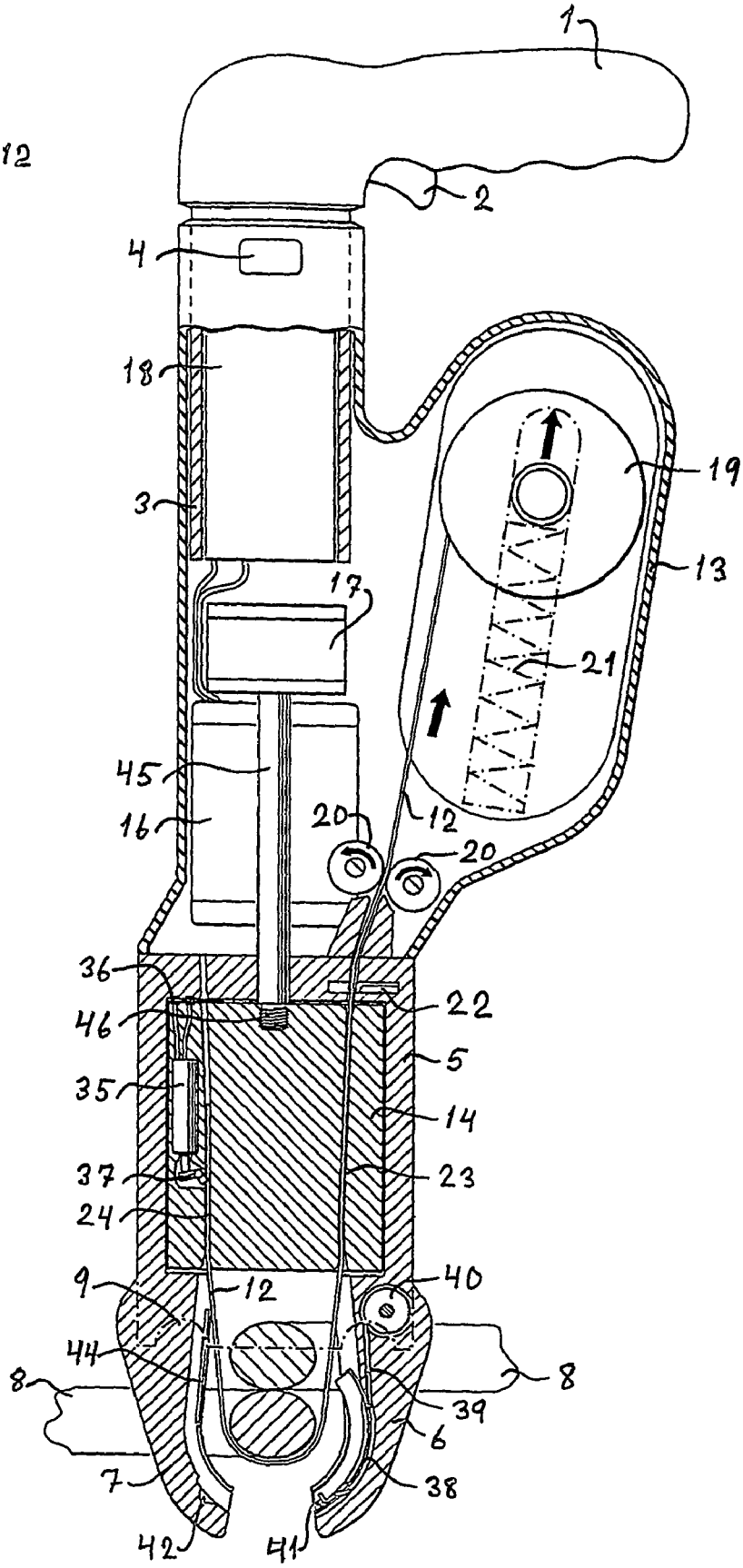

As regards FIGS. 10-12 reference is made to the description of FIGS. 5-7 showing the previously described embodiment in certain operation states.

Figure 13:
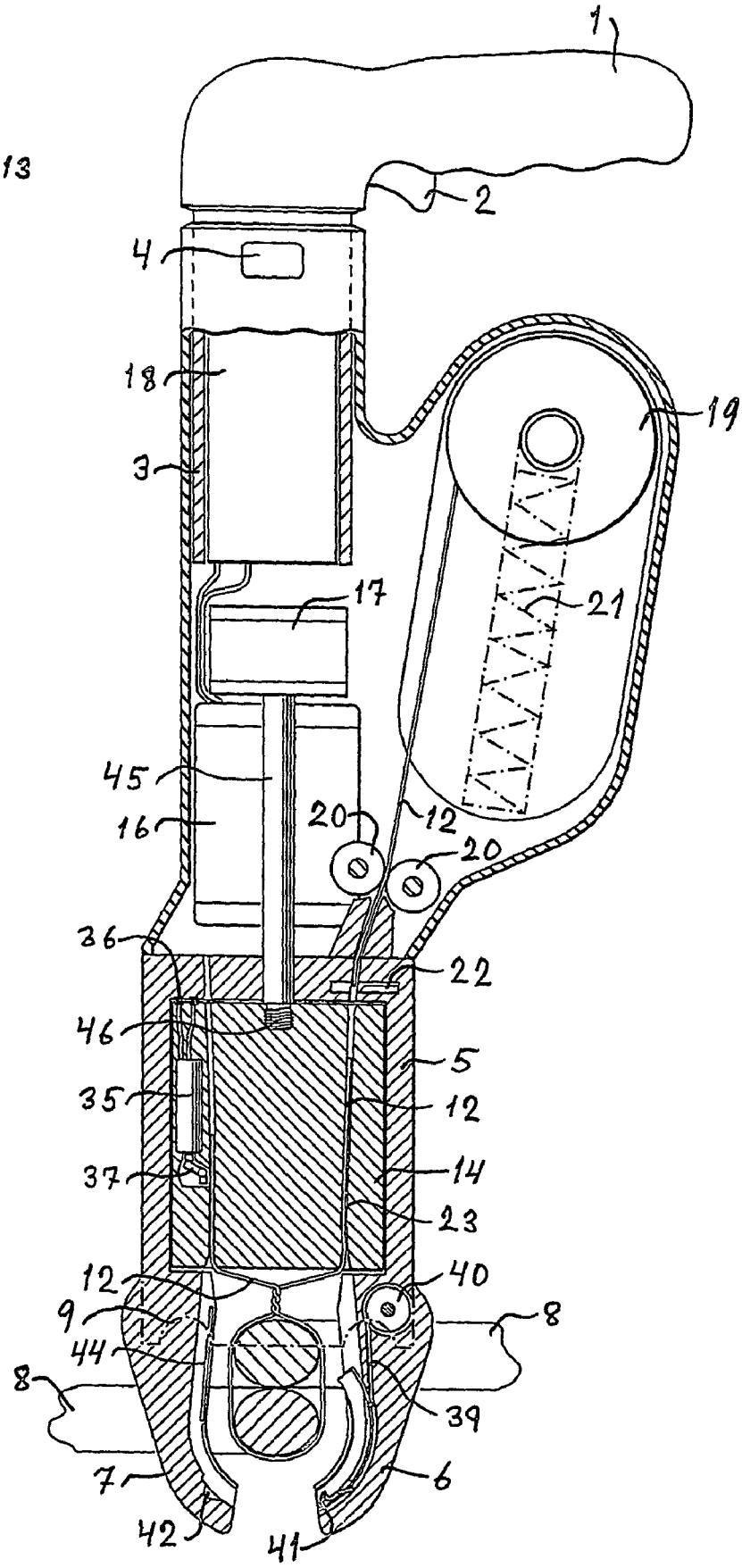

Following the step illustrated in FIG. 12 the wire 12 is cut off by means of the knife 22, and the solenoid 35 is deactivated, so that the locking means 37 frees the wire end, see FIG. 13. Then the motor 16 is started, which causes the drive shaft 45 to rotate. Due to the coupling between the shaft and the inner cylinder 14 also this cylinder will be carried along in the rotation of the shaft.

Owing to the rotation of the inner cylinder 14, the ends of the wire 12 will be twisted together on the top side of the uppermost reinforcing bar 8 and will in this connection bring about secure binding-together of the reinforcing bars at the intersection point. To achieve tight binding-together of the reinforcing bars, there must be a certain tension in the wire during the twisting operation. This tension is created due to the resistance that must be overcome when pulling out the wire. The resistance is caused by the friction between the wire and the ducts 23 and 24 in the inner cylinder and especially the friction against the edges of the lower mouths of the ducts where the wire is bent when pulled out at an oblique angle during a twisting operation. In order to increase this friction a ring of rubber or other high friction and wear-resistant material can be arranged in the mouths.

The friction can also be increased by reducing the area of the ducts over their total length or just as one or more restrictions in the ducts. The ducts can also comprise different sections which form a small angle relatively each other.

The result of a twisting operation is shown in FIG. 13.

As an alternative to the previously described retraction of the wire, shown in FIGS. 6 and 12, in order to obtain a stretching of the wire around the reinforcing bars 8 to be bound together, after the feed of the wire has been stopped a pulling force can be applied to the leading end portion of the wire 12 which has been fed up into the guide duct 24 in the inner cylinder 14. This pulling force can be applied by means of two feed rollers which can be of the same kind as the feed rollers 20 and arranged in the inner cylinder 14.

In order to obtain a strong stretching of the wire so that it closely surrounds the reinforcing bars 8 to be twisted together the feed of the wire through the first guide duct 23 is positively locked before the pulling force is applied. This can be obtained by means of a solenoid actuated locking means arranged in the inner cylinder 14 so that it locks the wire in the first guide duct 23 in the same manner as the solenoid actuated locking means 37 of the earlier described embodiment locks the wire in the second guide duct 24.

Alternatively the locking of the wire 12 can be obtained by means of locking of the feed rollers 20 or the reel 19 for rotation or in any other manner obvious to the skilled man.

The above described alternative manner of stretching the wire around the bars to be twisted together results in an even less complicated machine as the reel 19 for lashing wire 12 does not have to be displaceable but just rotatable.

If so required, the machine can be provided with means which, after lashing has been performed, bend down the twisted-together wire ends so as to avoid risks of injury. For this purpose, the operator can alternatively use one of the impact-resistant claws. The outer surface of this can then suitably be provided with a roller for interaction with the wire ends. In order to facilitate feed of the wire 12 into the inner cylinder 14 before a work operation, the inner and outer cylinders can be made with spring-loaded position-adjusting means which cause the inner cylinder always to return to exactly the same position relative to the outer cylinder after each completed work cycle.

The invention has been described above in connection with two embodiments shown in the drawings. However, as the man of art will readily understand, these can be varied in a number of respects within the scope of the claims as far as various detailed solutions are concerned. The elastic ball of the first embodiment can for instance be replaced by an element of a different design, which can interact with the scissors-like construction or another arrangement for securing the wire in the guide ducts. It is important that the arrangement brings about the requisite retention of the wire in order to make tight lashing-together of the reinforcing bars possible but allows the necessary length of the wire to be drawn past the arrangement in order to prevent excessive tension being built up in the wire, which may, for example, lead to the wire breaking. The expert in the field can propose alternative arrangements with this function.

Alternatively, this arrangement can be made in such a way that, instead of continually braking the drawing-out of the wire, it intermittently frees the wire completely for short periods of time and locks it completely during intermediate periods. Likewise, the design of the guide channel bridging the gap between the fixed claws can be varied in different respects.

The work sequences described above can be performed automatically after starting by pressing-in the activating button 2 under the control of an electronic unit (not shown). The programming of this control unit can be performed by the skilled man and has therefore been omitted so as not to prolong this description unnecessarily.

The invention claimed is:

1. A method for binding elongate objects together by means of at least one wire, two claws provided with guide surfaces for the wire being guided down over the objects to be bound together, after which a wire is fed along the guide surface of one claw and across to the guide surface of the other claw, so that it is shaped into a wire loop surrounding the said objects on three sides, wherein the wire is fed to the guide surface of one claw via a first guide arrangement in an arrangement which is rotatable relative to the claws, and is fed away from the second claw via a second guide arrangement in the rotatable arrangement, after the wire has been fed to the second guide arrangement, the wire is fixed therein while a retracting force is applied to the wire to bring about stretching of the latter around the objects to be bound together, the rotatable arrangement is made to rotate for twisting-together of the two parts of the wire for binding together the objects the wire surrounds, and, during twisting together, the wire is held in each guide arrangement in the rotatable arrangement such that the wire length necessary for twisting-together of the wire parts is allowed to be drawn out while a resistance is overcome.

2. The method according to claim 1, wherein, after the wire has been fed to the second guide arrangement, the feed of the wire through the first guide arrangement is stopped and a pulling force is applied to the leading end portion of the wire to bring about stretching of the wire around the objects to be bound together.

3. The method according to claim 1, wherein the wire is fed to the claws from a reel, and in that it is cut off before the rotatable arrangement is made to rotate.

4. The method according to claim 1, wherein the wire is fed across from the guide surface of one claw to the guide surface of the other claw via a movable means which is guided by the first-mentioned claw and is carried along by the wire in its feed movement.

5. A machine for binding elongate objects together by means of at least one wire, which machine comprises two claws provided with guide surfaces for the wire, which claws can be guided down over the objects to be bound together, a wire feed arrangement for feeding the wire along the guide surface of one claw and across to the guide surface of the other claw, so that it is shaped into a wire loop surrounding the objects on three sides, a wire retracting arrangement for applying a retracting force to the wire to bring about stretching of the latter around the objects to be bound together and a twisting arrangement for twisting the legs of the wire loop obtained together on the fourth side of the objects, wherein the twisting arrangement comprises rotatable arrangement, which is rotatable relative to the claws, with a first guide arrangement, via which the wire is fed to the guide surface of one claw, and a second guide arrangement, via which the wire is fed away from the second claw, the guide arrangements being located eccentrically in relation to the axis of rotation of the rotatable arrangement, and the respective guide arrangement being designed or provided with an arrangement such that during rotation of the rotatable arrangement, the wire length necessary for twisting-together of the legs of the wire loop is allowed to be drawn out while a resistance is overcome and wherein the wire retracting arrangement is arranged to apply said retracting force before twisting together of the ends of the wire begins.

6. The machine according to claim 5, wherein it comprises a reel of wire, a wire drawing arrangement for drawing wire off from the reel, and a wire cutting arrangement for cutting the wire off before the rotatable arrangement begins to rotate.

7. The machine according to claim 5, wherein the guide arrangements are in the form of guide ducts which run in the axial direction through the rotatable arrangement.

8. The machine according to claim 5, wherein the rotatable arrangement is in the form of a cylinder with guide ducts for the wire passing through in the axial direction, and in that the cylinder is arranged rotatably in an outer cylindrical guide.

9. The machine according to claim 8, wherein the outer cylindrical guide is fixed, and in that the claws are connected firmly to this outer cylindrical guide.

10. The machine according to claim 9, wherein the outer cylindrical guide is made as a support with seats for interaction with the objects to be bound together, when the machine rests on the objects during performance of a work operation.

11. The machine according to claim 5, further comprising a wire fixing arrangement for fixing the wire in the second guide arrangement in connection with the retraction.

12. The machine according to claim 5, wherein, during feed of the wire, the wire reel is movable in the feed direction of the wire, counter to the action of a spring force, and in that the retraction is adapted so as to take place while the reel is being returned by the spring force.

13. The machine according to claim 5, further comprising a pulling arrangement for applying a pulling force to the leading end portion of the wire to bring about stretching of the wire around the objects to be bound together, before twisting together of the ends of the wire begins.

14. The machine according to claim 5, wherein the wire feed arrangement is arranged to stop the feed of the wire through the first guide arrangement in connection with said stretching of the wire.

15. The machine according to claim 5, wherein at least the guide surface of the other claw is made in the form of a guide groove, and in that the guide groove is closed by a cover which allows the wire to be drawn out past these when a retracting force is applied to the wire for stretching the latter around the objects to be twisted together.

16. The machine according to claim 5, further comprising a movable guide channel which is guided by the one claw and is adapted so as to be carried along by the wire in its feed movement in order to bridge the gap between the two claws when the wire is fed across from the guide surface of one claw to the guide surface of the other claw.

17. The machine according to claim 16, wherein the guide channel comprises an open channel with a stop, with which the front end of the wire is adapted to interact in order to carry the guide means along in the feed movement of the wire and which stop is adapted so as to free the front end of the wire when the wire end has reached the guide surface of the second claw.

18. The machine according to claim 16, wherein the guide channel is displaced counter to the action of a spring force which returns the guide channel when the front end of the wire has reached the guide surface of the second claw.

19. The machine according to claim 5, wherein two engagement elements intended for securing the wire in the respective duct are arranged in the inner cylinder, wherein the engagement elements are mounted pivotably in the inner cylinder and adapted so as to be pivoted outwards for engagement with the wire in the respective duct due to an actuating arrangement which is movable axially into the inner cylinder.

20. The machine according to claim 19, wherein the engagement elements have a pivoted construction with two legs which are pivotable relative to one another, the one ends of the legs being adapted so as to be pressed outwards for engagement with the wire in the respective duct when the actuating arrangement is pressed in between the other ends of the legs.

21. The machine according to claim 20, wherein a first part of the actuating arrangement, which part is intended for interaction with the other ends of the legs, is somewhat elastic and adapted so as, when it rotates, to be capable of carrying the pivotted construction and the inner cylinder along in the rotation movement.

22. The machine according to claim 21, wherein the actuating arrangement comprises a second, rotatable part adapted so as to enter into engagement with the first part and in this connection to cause the latter to rotate.

23. The machine according to claim 22, wherein the second part of the actuating arrangement consists of a sleeve-shaped spindle, in that the first, elastic part of the actuating arrangement is in the form of a ball with a guide pin projecting into the sleeve and adapted so as to be capable of being pressed further into the sleeve counter to the action of a spring.

* * * * *